US008308117B2

(12) United States Patent
Braun

(10) Patent No.: US 8,308,117 B2
(45) Date of Patent: Nov. 13, 2012

(54) MOUNTING SYSTEMS

(75) Inventor: Frank Michael Braun, Grundau (DE)

(73) Assignee: nie wieder bohren ag, Hanau (DE)

( * ) Notice: Subject to any disclaimer, the term of this patent is extended or adjusted under 35 U.S.C. 154(b) by 6 days.

(21) Appl. No.: 12/905,429

(22) Filed: Oct. 15, 2010

(65) Prior Publication Data

US 2012/0091301 A1 Apr. 19, 2012

(51) Int. Cl.
*A47F 5/08* (2006.01)

(52) U.S. Cl. ..... 248/231.91; 248/217.4; 411/133; 411/998

(58) Field of Classification Search ..... 248/231.91, 248/205.1, 216.1, 216.4, 217.3, 217.2, 217.4, 248/547, 544, 546; 411/439, 457, 133, 998, 411/103

See application file for complete search history.

(56) References Cited

U.S. PATENT DOCUMENTS 1,261,130 A * 4/1918 Jasper ..... 411/133
1,545,182 A * 7/1925 Beck ..... 411/103
2,202,811 A * 6/1940 Carney et al. ..... 248/217.4
2,542,941 A * 2/1951 Post ..... 248/205.1
2,601,872 A * 7/1952 Kaufmann ..... 139/88
3,532,316 A 10/1970 Mathes
3,964,531 A 6/1976 Schenk ..... 151/41.7
4,763,456 A * 8/1988 Giannuzzi ..... 52/410
4,907,771 A * 3/1990 Wang ..... 248/222.14
4,923,159 A 5/1990 Wang et al.
5,029,786 A 7/1991 Wu
5,065,489 A 11/1991 Mullen et al. ..... 29/281.5
5,875,903 A * 3/1999 Chen ..... 211/105.1
7,510,360 B2 * 3/2009 Ernst et al. ..... 411/400
2006/0175496 A1 * 8/2006 Lai ..... 248/251
2009/0108155 A1 * 4/2009 Benitez ..... 248/217.4

* cited by examiner

*Primary Examiner* — Anita M King
(74) *Attorney, Agent, or Firm* — MacCord Mason PLLC

(57) ABSTRACT

Drywall mounting systems for accessories are shown and described. In one example, a system includes an accessory adapter plate, a fixation plate, a drywall fastener, and a second fastener. The drywall fastener is used to secure the accessory adapter plate to the drywall. The fixation plate is then secured to the accessory adapter plate with the second fastener, which, inter alia, prevents the rotation of the accessory adapter plate. Accessories can then be quickly and securely attached to the accessory adapter plate.

21 Claims, 7 Drawing Sheets

MOUNTING SYSTEMS

FIELD OF TECHNOLOGY

The current disclosure relates generally to mounting systems for accessories, and more particularly, to mounting systems for drywall.

SUMMARY

Drywall, also intended herein to include gypsum board, wallboard, plasterboard, Gibraltar board, rock lath, rigips, regips, knauf, etc. and similar structures, is known in the art. A common drywall construction example includes a panel made of gypsum plaster pressed between sheets of paper. Drywall can be quickly hung to create walls and ceilings in buildings. Oftentimes, accessories will be attached to drywall. In the bathroom or kitchen, for example, accessories may include towel racks, trays, soap holders, mirrors, hand rails, etc.

Applicant believes traditional mounting systems may suffer from any variety of problems. For example, traditional mounting systems may require directional components, e.g., those that have a defined top and a bottom. Further, traditional mounting systems may require portions of the system to be mounted to the wall in a level positioning to insure proper interface with the accessory. Further, traditional mounting systems may attach to the wall at some distance off center from where the accessory is to be positioned, thereby requiring additional measurements to determine the appropriate offset needed. Further, traditional mounting systems may be weakly mounted to the wall and may pull out or damage the drywall if excessive force is applied.

Various examples of the current disclosure may be directed to at least one of these, or additional, problems.

SUMMARY

The current disclosure is directed to a variety of mounting systems. In one example, a system includes an accessory adapter plate, a fixation plate, a drywall fastener, and a second fastener. The drywall fastener is used to secure the accessory adapter plate to the drywall. The fixation plate is then secured to the accessory adapter plate with the second fastener, which, inter alia, prevents the rotation of the accessory adapter plate. Accessories can then be quickly and securely attached to the accessory adapter plate.

The above summary was intended to summarize certain examples of the present disclosure. Systems, including additional embodiments, will be set forth in more detail in the figures and detailed description below. It will be apparent, however, that the detailed description is not intended to limit the present invention, the scope of which should be properly determined by the appended claims.

DETAILED DESCRIPTION OF EXEMPLARY EMBODIMENTS

Figure 1:
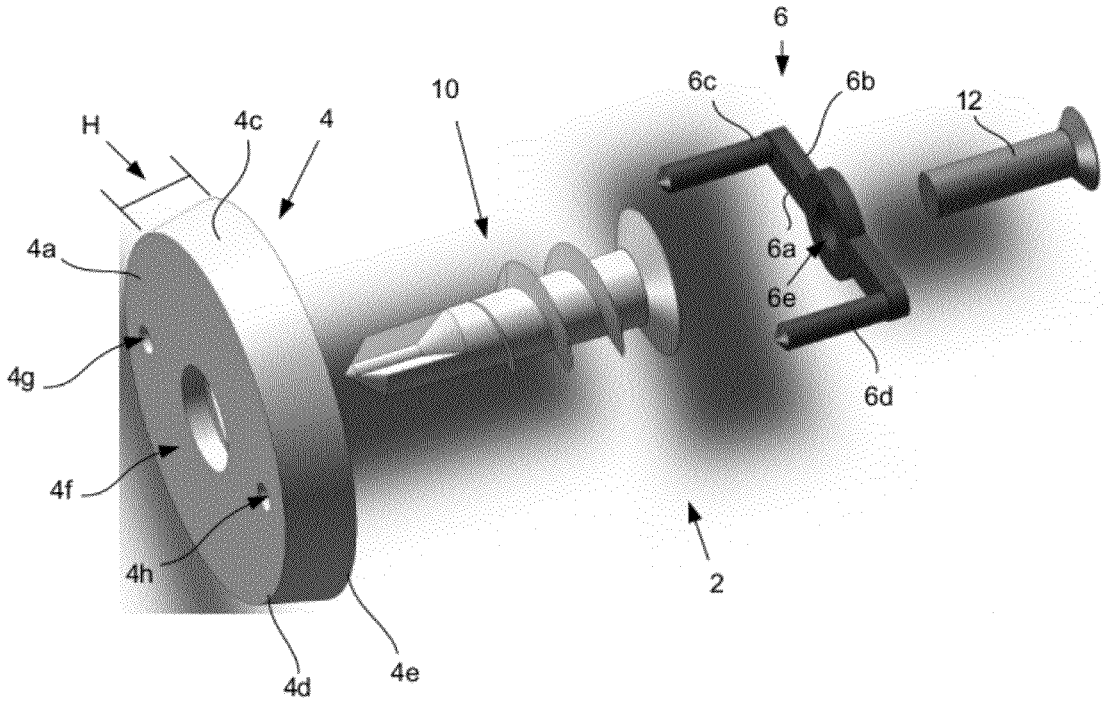
FIG. 1 illustrates a perspective view of a first embodiment of a mounting system according to the disclosure.
Figure 2:
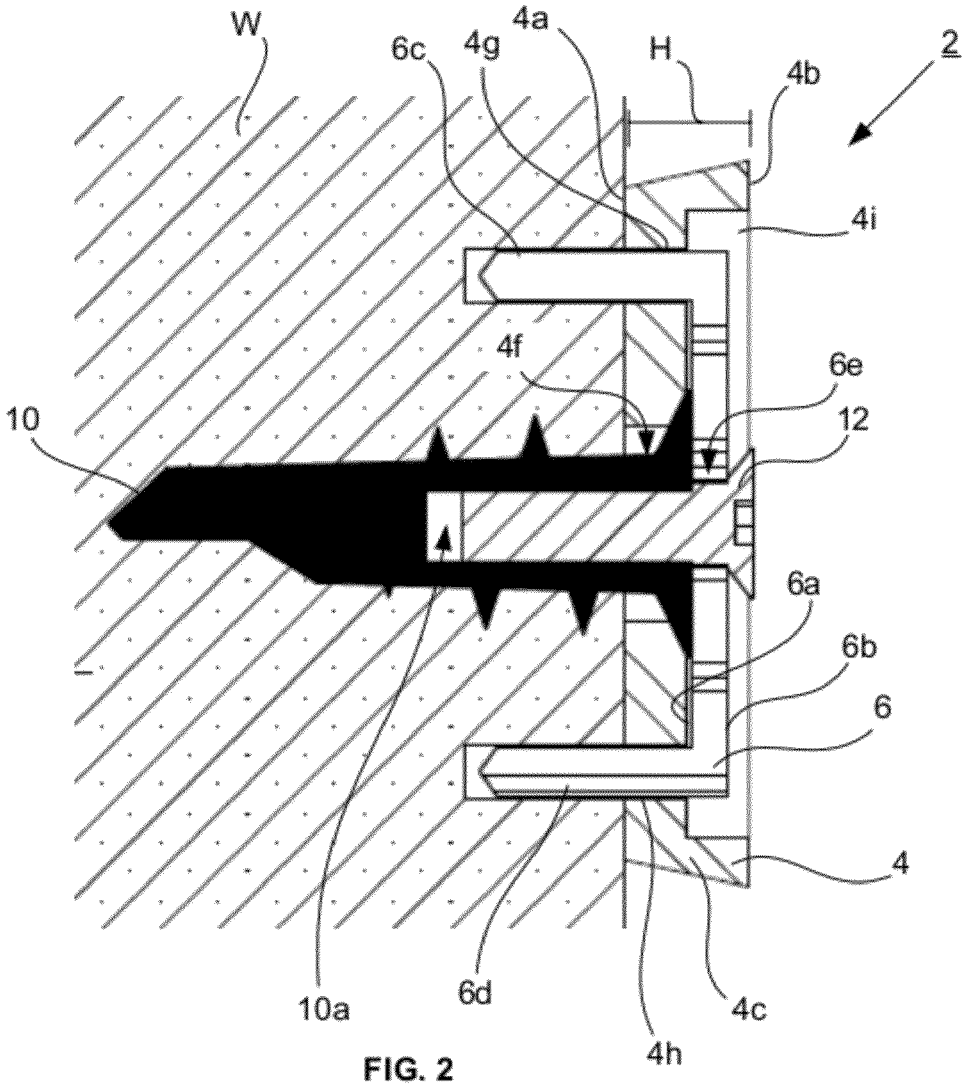
FIG. 2 illustrates a cut-away view of mounting system shown in FIG. 1.

As noted, the current disclosure is directed to a variety of mounting systems for mounting to drywall to provide an interface with an accessory. FIG. 1 illustrates a perspective view of mounting system 2, which represents a first embodiment of a mounting system as disclosed herein. FIG. 2 illustrates a cut-away view of mounting system 2 interfaced with drywall W. System 2 is also configured for interfacing with an accessory, which will be discussed in more detail below.

Referring to both FIGS. 1 and 2, system 2 includes an accessory adapter plate ( accessory adapter plate) 4, a fixation plate 6, a drywall fastener 10, and a second fastener 12. Briefly, in terms of operation, drywall fastener 10 is used to secure accessory adapter plate 4 to the wall. Fixation plate 6 is then secured to accessory adapter plate 4 with second fastener 12 to prevent the rotation of the accessory adapter plate. Accessories can then be quickly and securely attached to the accessory adapter plate.

In the majority of examples, accessory adapter plates will be non-directional, meaning it can be installed without concern for a top or bottom, etc. In the example shown, accessory adapter plate 4 is circular and non-directional, but other shapes may be used for a non-directional configuration, e.g. squares or other regular polygons.

Accessory adapter plate 4 includes a (wall side) 4*a* for abutting wall W. Accessory adapter plate's wall side 4*a* may be substantially planar, thereby allowing accessory adapter plate 4 to flushly abut wall W. In other examples, wall-sides may have other surfaces or textures to accommodate the surfaces of other walls. Opposite wall side 4*a* is accessory-side (AS) 4*b* for positioning proximal to the accessory. In between the wall side and the stabilization aperture, the accessory adapter plate defines a perimeter wall 4*c* having a height. The height may vary from example to example, e.g., from 3 mm to 20 mm. In many examples, the height will be from about 4 mm to about 7 mm. Other examples, include other sizes.

Accessory adapter plate 4 includes a wall side perimeter 4*d* defined by wall side and an accessory side perimeter 4*e* defined by the accessory side. In this example, the accessory side perimeter is a greater length than the wall side perimeter, but in other examples, the accessory side perimeter and wall side perimeter can be of different lengths, e.g., the accessory side perimeter and wall side perimeter can be the same length.

Accessory adapter plate 4 defines stabilization apertures 4*g* and 4*h*, which are examples of an accessory adapter plate having at least one stabilization aperture. Some examples include a single stabilization aperture, and some examples include a 3, 4, 5 or more stabilization apertures. Stabilization aperture positioning may vary from example to example, for example, stabilization apertures may be positioned radially in the accessory adapter plate.

As seen, in this example fastener 10 is a distinct drywall fastener, and accessory adapter plate 4 defines a mounting aperture 4*f* for receiving drywall fastener 10. Further, drywall fastener 10 defines an aperture 10*a* for receiving the second fastener 12. In this example, mounting aperture is centrally located in said accessory adapter plate, but in other examples, mounting apertures can be located in other places.

System 2 also includes a fixation plate 6, which is one example of a fixation plate as used herein. Fixation plate 6 includes a first side 6*a* for positioning proximal to the accessory adapter plate, and a second side 6*b* for positioning proximal to the accessory.

Fixation plate 6 also includes at least one projection, e.g., 6*c* or 6*d*, which may extend from the first side. Fixation plate projections are typically configured to align with the stabilization aperture of the accessory adapter plate when the fixation plate-fixation plate is secured to the accessory adapter plate. In the example shown, for example, projection 6*c* extends through the stabilization aperture 4*g* and projection 6*d* extends through projection 4*h*. Projections will commonly have a length sufficient to extend through the accessory adapter plate and penetrate the wall. For example, projections may penetrate at least 0.5 cm into the wall. In other examples, projections may penetrate to other depths.

In some examples, as illustrated, the accessory adapter plate will define a recessed channel, e.g., 4*i*, for receiving the fixation plate. The shape of the recessed channel may vary from embodiment to embodiment.

Fixation plate 6 includes mounting aperture 6*e*. In this example, mounting aperture 6*e* is configured to overlap aperture 10*a* of the dry wall fastener, thereby allowing second fastener 12 to secure fixation plate 6 the accessory adapter plate 4.

Using system 2, the accessory adapter plate 4 can be attached to wall W quickly in the desired location using drywall fastener 10, e.g., by rotating fastener 10 using a screw driver. Fixation plate 6 can then be positioned relative to accessory adapter plate 4 such that projections 6*c* and 6*d* of fixation plate 6 align with the stabilization aperture 4*g* and the stabilization aperture 4*h*, and, such that mounting aperture 6*e* aligns with aperture 10*a* of the drywall fastener. Second fastener 12 is then inserted through mounting aperture 6*e* and into aperture 10*a*, where it is secured, for example, by rotation. The tightening of fastener 12 may serve to force projections 6*c* and 6*d* into the drywall. Projections may also be driven into the drywall prior to rotation of the fastener.

Figure 3:
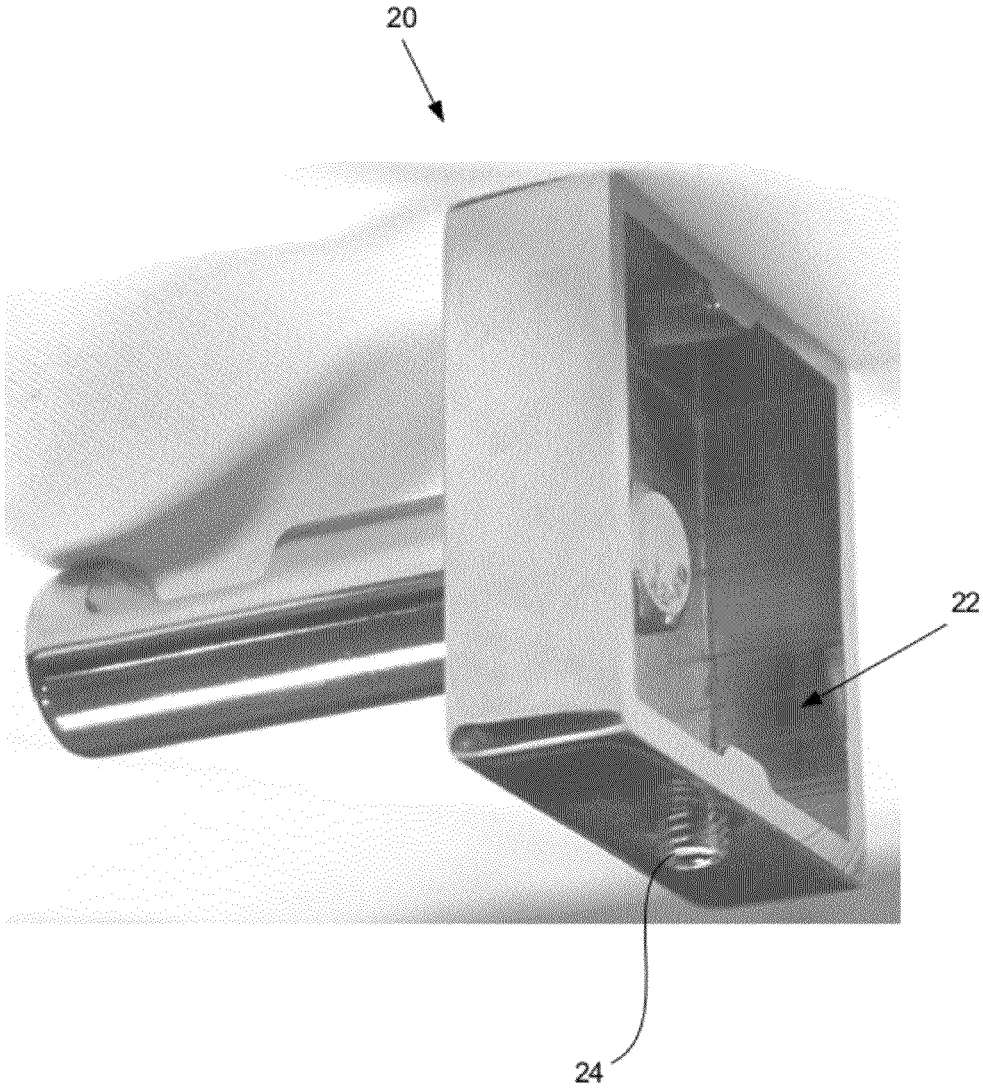
FIG. 3 illustrates an accessory example.

Once system 2 is secured to the wall, for example as seen in FIG. 2, any of a variety of accessories may be attached to the accessory adapter plate. FIG. 3 illustrates accessory 20, which is one example of an accessory capable of attaching to mounting systems disclosed herein. In this example, accessory 20 is a hook, e.g., for hand towels, utensils, etc. Accessories include a cavity, e.g. cavity 22, for receiving the accessory adapter plate of the mounting system. Accessories may also include a securing means, e.g. set screw 24, for securing the accessory to the accessory adapter plate once the accessory cavity has received the accessory adapter plate. Further, accessories may attach to accessory adapter plates in a manner that reduces an accessory's tendency to rotate. For example, an accessory adapter plate's perimeter wall may define at least one groove running from the wall side to the accessory side , which increases the purchase of the securing means 24 and reduces rotational movement of the accessory relative to said accessory adapter plate. In other examples, grooves may be located in other ways. Further, in some examples, groves or flanges may be included to reduce an accessories tendency from being pulled off the accessory adapter plate un-intentionally.

It should be clear that a plurality of mounting systems may be used to interface with an accessory. For example, larger accessories, e.g., mirrors, shelves, hand rails, etc., may include a plurality of cavities for receiving any number of accessory adapter plates.

Another benefit of many examples of the mounting system, e.g. those including a centrally located mounting aperture, is that they allow the mounting system to be attached to the wall centered at the point where accessory is to be positioned or attached, for example, without needing to calculate for a suspension distance created by many traditional mounting hooks and plates.

In addition to the above benefits, many mounting systems will provide an exceptionally strong interface to the drywall, without requiring additional support structures, e.g., drywall toggle bolts or other devices located behind the drywall. Further, mounting systems disclosed herein can be readily removed from the drywall with minimal damage to wall surface or structural integrity.

Figure 4:
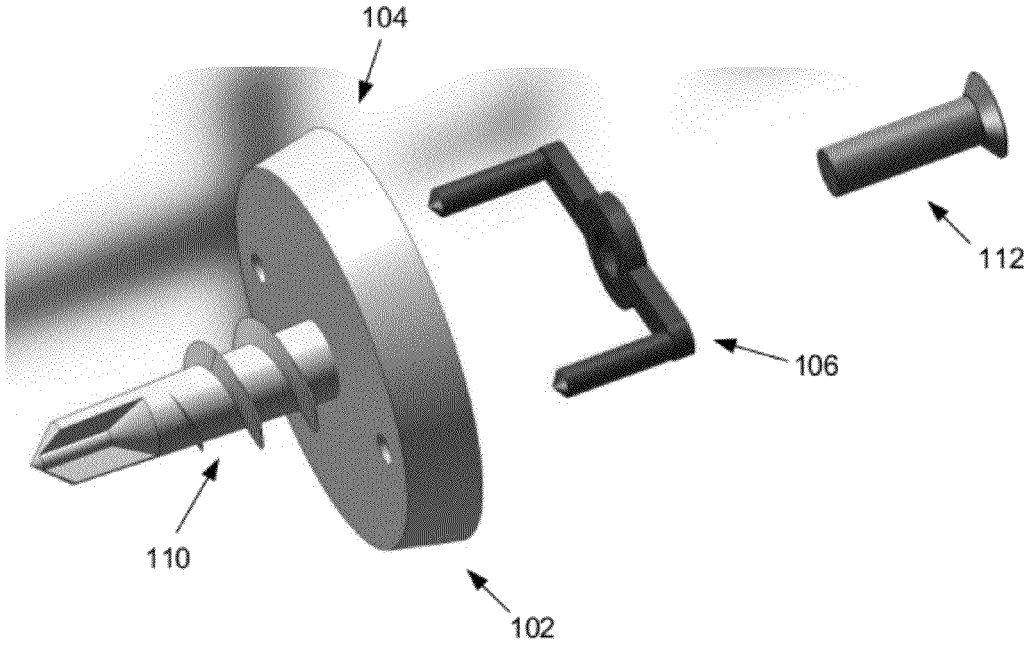
FIG. 4 illustrates a perspective view of a second embodiment of a mounting system.

FIG. 4 illustrates mounting system 102, which represents a second embodiment of a mounting system disclosed herein. The second embodiment, similar to the first embodiment, includes an accessory adapter plate 104, a fixation plate 106, a drywall fastener 110, and a second fastener 112. The second embodiment differs from the first embodiment in that drywall fastener 110 is connected to the accessory adapter plate 110. Using second embodiment examples, the accessory adapter plate can be fastened to the drywall simply by rotating the accessory adapter plate by hand. The accessory adapter plate may also be fastened using a tool, e.g. pliers, for example. Other parts may be similar to any of those described for the first embodiment.

Figure 5:
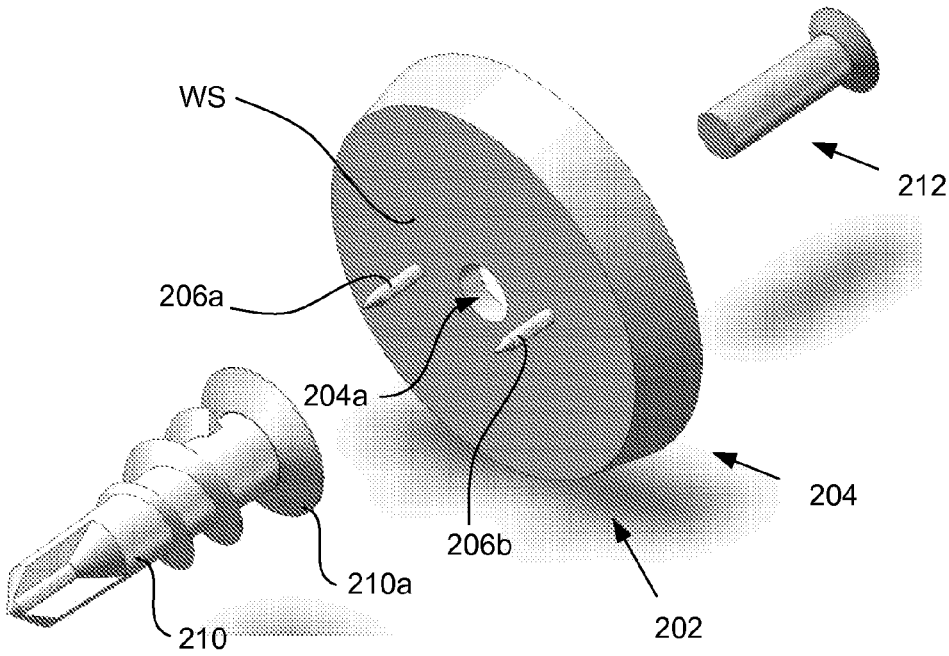
FIGS. 5 and 6 illustrate perspective views of a third embodiment of a mounting system.
Figure 6:
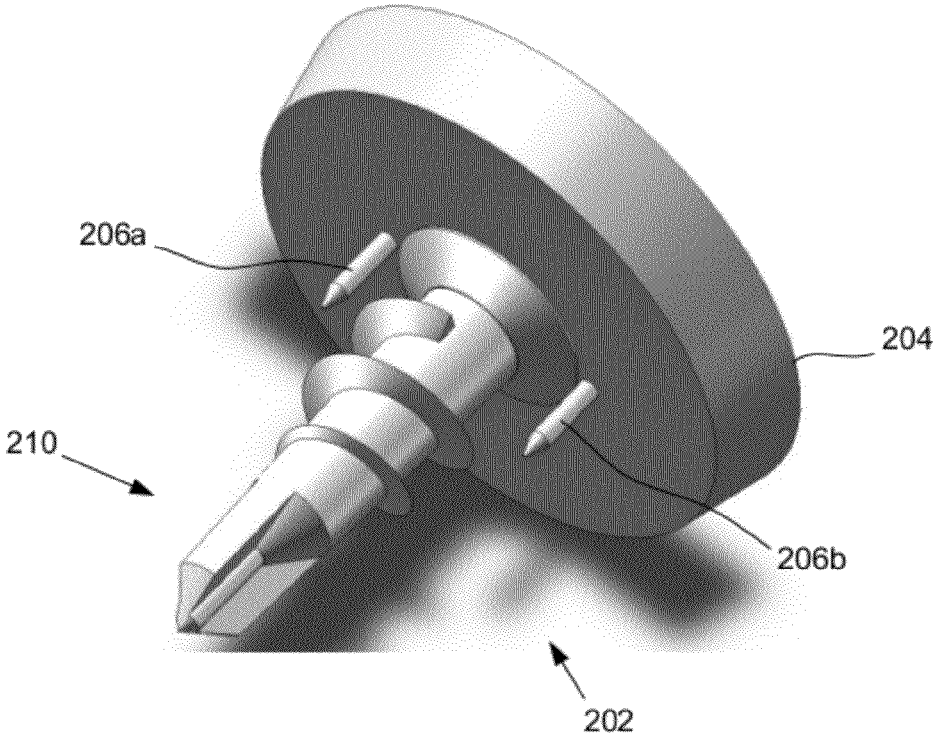

FIGS. 5 and 6 illustrate mounting system 202, which represents a third embodiment of a mounting system disclosed herein. The third embodiment, similar to the previous embodiments, includes an accessory adapter plate 204, a drywall fastener 210, and a secondary fastener 212 (not visible in FIG. 6). Drywall fastener 210 includes a channel for receiving the secondary fastener as previously discussed. The third embodiment differs from the previous two embodiments in that it does not include a fixation plate. Further, the accessory adapter plate includes at least one projection, e.g., 206*a* and 206*b*.

In terms of operation, drywall fastener 210 is inserted in the desired location. The accessory adapter plate 204 is then positioned over drywall fastener 210 such that mounting aperture 204*a* aligns with the channel for receiving the secondary fastener. The secondary fastener is then used to secure the accessory, adapter plate 204 to the drywall fastener. In this example, the drywall fastener, e.g., head 210*a*, is configured to abut the wall side of the accessory adapter plate. Head 210*a* will typically be flat on its surface and larger than the opening size of the mounting aperture 204*a*.

Other parts of the mounting system may be similar to those described in the previous embodiments.

Figure 7:
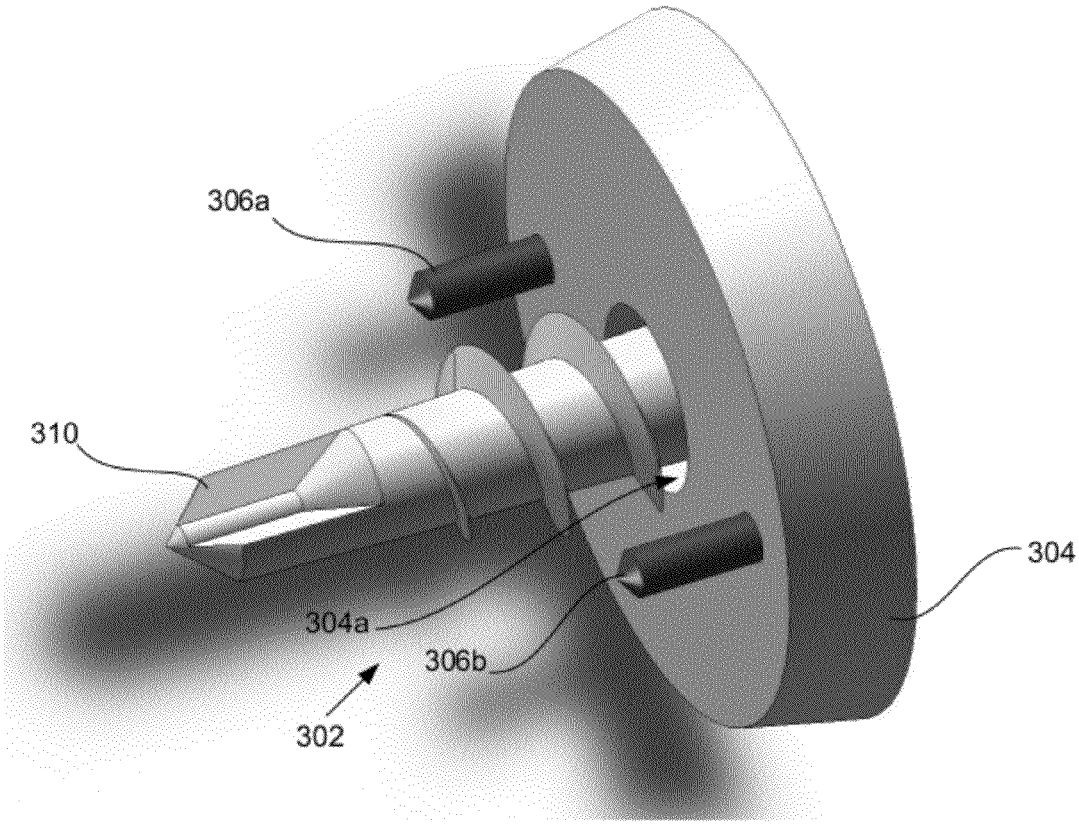
FIG. 7 illustrates a perspective view of a fourth embodiment of a mounting system.

FIG. 7 illustrates mounting system 302, which represents a fourth embodiment of a mounting system as disclosed herein. The fourth embodiment, similar to previous embodiments includes an accessory adapter plate 304, and a discrete drywall fastener 310. Similar to the third embodiment, the accessory adapter plate 304 defines at least one projection, e.g. 306*a* and 306*b*, and does not include a fixation plate. In this embodiment, the accessory adapter plate 304 includes a mounting aperture mounting aperture 304*a*, and drywall fastener 310 is configured to be received by mounting aperture and secure the accessory adapter plate 304 to the wall by penetration.

Numerous characteristics and advantages have been set forth in the foregoing description, together with details of structure and function. Using the disclosure contained herein, a variety of accessories can be readily attached to walls. The disclosure, however, is illustrative only, and changes may be made in detail, especially in matters of shape, size, and arrangement of parts, within the principle of the invention, to the full extent indicated by the broad general meaning of the terms in which the general claims are expressed.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein, and every number between the end points. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10, as well as all ranges beginning and ending within the end points, e.g. 2 to 9, 3 to 8, 3 to 9, 4 to 7, and finally to each number 1, 2, 3, 4, 5, 6, 7, 8, 9 and 10 contained within the range. Additionally, any reference referred to as being "incorporated herein" is to be understood as being incorporated in its entirety.

It is further noted that, as used in this specification, the singular forms "a," "an," and "the" include plural referents unless expressly and unequivocally limited to one referent.

What is claimed is:

1. A mounting system for interfacing with a wall and an accessory, said system comprising:
- an accessory adapter plate having
  - a wall-side for abutting the wall,
  - an accessory-side for positioning proximal to the accessory, and
  - a perimeter wall having a height, a wall side perimeter and an accessory side perimeter,
  - wherein said accessory adapter plate defines at least one stabilization aperture;
- a fixation plate having
  - a first side for positioning proximal to said accessory adapter plate,
  - a second side for positioning proximal to the accessory, and
  - at least one projection extending from said first side,
  - wherein said fixation plate defines a fixation plate mounting aperture;
- a drywall fastener configured to secure said accessory adapter plate to the wall, and
- a second fastener configured to secure said fixation plate to said accessory adapter plate,
- wherein said fixation plate's at least one projection is configured to align with said accessory adapter plate's stabilization aperture when said fixation plate is secured to said accessory adapter plate.

2. The system of claim 1, wherein said wall side of said accessory adapter plate is substantially planar, thereby allowing said accessory adapter plate to flushly abut the wall.

3. The system of claim 1, wherein said accessory side of said accessory adapter plate defines a recessed channel encompassing said stabilization aperture.

4. The system of claim 1, wherein said accessory side perimeter is greater than or equal to said wall side perimeter.

5. The system of claim 1, wherein said accessory side perimeter is greater than said wall side perimeter.

6. The system of claim 1, wherein the height of said perimeter wall is from 3 mm to 20 mm.

7. The system of claim 1, wherein said perimeter wall defines at least one groove for facilitating interface with the accessory.

8. The system of claim 1, wherein said fixation plate's at least one projection has a length sufficient to extend through said accessory adapter plate and penetrate the wall.

9. The system of claim 1, wherein said stabilization aperture is radially located in said accessory adapter plate.

10. The system of claim 1, wherein said accessory adapter plate is non-directional, whereby it can be interfaced with the accessory regardless of its rotational orientation relative to the wall.

11. The system of claim 10, wherein said accessory adapter plate is circular.

12. The system of claim 1, wherein said drywall fastener is a distinct fastener, and wherein said accessory adapter plate defines a mounting aperture for receiving said drywall fastener.

13. The system of claim 1, wherein said drywall fastener is connected to said accessory adapter plate.

14. A mounting system for interfacing with a wall and an accessory, said system comprising:
- an accessory adapter plate having
  - a wall-side for abutting the wall,
  - an accessory-side for positioning proximal to the accessory, and
  - a perimeter wall having a height, a wall side perimeter and an accessory side perimeter,
  - wherein said accessory adapter plate defines at least one stabilization aperture;
- a fixation plate having
  - a first side for positioning proximal to said accessory adapter plate,
  - a second side for positioning proximal to the accessory, and
  - at least one projection extending from said first side,
  - wherein said fixation plate defines a fixation plate mounting aperture;
- a drywall fastener configured to secure said accessory adapter plate to the wall, and
- a second fastener configured to secure said fixation plate to said accessory adapter plate,
- wherein said accessory side of said accessory adapter plate defines a recessed channel encompassing said stabilization aperture.

15. The system of claim 14, wherein said recessed channel has a shape and depth for receiving said fixation plate.

16. A mounting system for interfacing with a wall and an accessory, said system comprising:
- an accessory adapter plate having
  - a wall-side for abutting the wall,
  - an accessory-side for positioning proximal to the accessory, and
  - a perimeter wall having a height, a wall side perimeter and an accessory side perimeter,
  - wherein said accessory adapter plate defines at least one stabilization aperture;
- a fixation plate having
  - a first side for positioning proximal to said accessory adapter plate,
  - a second side for positioning proximal to the accessory, and
  - at least one projection extending from said first side,
  - wherein said fixation plate defines a fixation plate mounting aperture;
- a drywall fastener configured to secure said accessory adapter plate to the wall, and
- a second fastener configured to secure said fixation plate to said accessory adapter plate, wherein said perimeter wall defines at least one groove for facilitating interface with the accessory.

17. The system of claim 16, wherein said at least one groove is oriented to reduce rotational movement of the accessory relative to said accessory adapter plate.

18. A mounting system for interfacing with a wall and an accessory, said system comprising:

an accessory adapter plate having a wall-side for abutting the wall, an accessory-side for positioning proximal to the accessory, and a perimeter wall having a height, a wall side perimeter and an accessory side perimeter, wherein said accessory adapter plate defines at least one stabilization aperture;

a fixation plate having a first side for positioning proximal to said accessory adapter plate, a second side for positioning proximal to the accessory, and at least one projection extending from said first side, wherein said fixation plate defines a fixation plate mounting aperture;

a drywall fastener configured to secure said accessory adapter plate to the wall, and a second fastener configured to secure said fixation plate to said accessory adapter plate, wherein said drywall fastener is a distinct fastener, and wherein said accessory adapter plate defines a mounting aperture for receiving said drywall fastener.

19. The system of claim 18, wherein said mounting aperture is centrally located in said accessory adapter plate.

20. The system of claim 19, wherein said fixation plate mounting aperture is configured to overlap said dry wall fastener.

21. The system of claim 20, wherein said drywall fastener defines an aperture for receiving said second fastener.

* * * * *